US005991933A

United States Patent [19]

Schaffer

[11] Patent Number: 5,991,933

[45] Date of Patent: Nov. 30, 1999

[54] TOILET WITH ODOR REMOVAL TUBE

[76] Inventor: Richard C. Schaffer, 3920 W. Vickery, Fort Worth, Tex. 76107-5626

[21] Appl. No.: 09/195,597

[22] Filed: Nov. 18, 1998

[51] Int. Cl.[6] ..... E03D 9/04

[52] U.S. Cl. ..... 4/216

[58] Field of Search ..... 4/216, 218, 210, 4/211, 209 R

[56] References Cited

U.S. PATENT DOCUMENTS 5,054,131 10/1991 Sim ..... 4/216
5,491,847 2/1996 Schaffer .
5,522,093 6/1996 Schaffer .
5,839,127 11/1998 Curiel ..... 4/216

FOREIGN PATENT DOCUMENTS 4-108928 9/1992 Japan .

*Primary Examiner*—David J. Walczak
*Assistant Examiner*—Khoa Huynh
*Attorney, Agent, or Firm*—Arthur F Zobal

[57] ABSTRACT

A toilet odor removal system which uses an overflow tube in the water tank and a float valve to open and close an opening in the overflow tube for water overflow purposes and for odor removal purposes respectively. The overflow tube extends through a side wall of the water tank to an exhaust system.

6 Claims, 5 Drawing Sheets

TOILET WITH ODOR REMOVAL TUBE

BACKGROUND OF THE INVENTION

1. Field of the Invention

The invention relates to an apparatus for removing odor from a toilet bowl.

2. Description of the Prior Art

Japanese Patent No. 4-108928(A) discloses a toilet which employs an exhaust system coupled to the rim flush duct for removing odor from the toilet bowl. It also discloses use of the overflow tube in the water tank as part of the odor exhaust system. The upper end of the overflow tube however, is always exposed to the water in the tank which could reduce the suction and result in the tank water being exposed to the odor.

SUMMARY OF THE INVENTION

It is an object of the invention for providing a toilet odor removal system using the overflow tube in the water tank and a valve to open and close an opening in the overflow tube for water overflow purposes and for odor removal purposes respectively. In the embodiment disclosed the overflow tube extends through a side wall of the water tank and the valve is a float valve located near the upper portion of the overflow tube.

BRIEF DESCRIPTION OF THE DRAWINGS

In FIG. 3, the float valve is in a closed position.

DESCRIPTION OF THE PREFERRED EMBODIMENT

Figure 1:
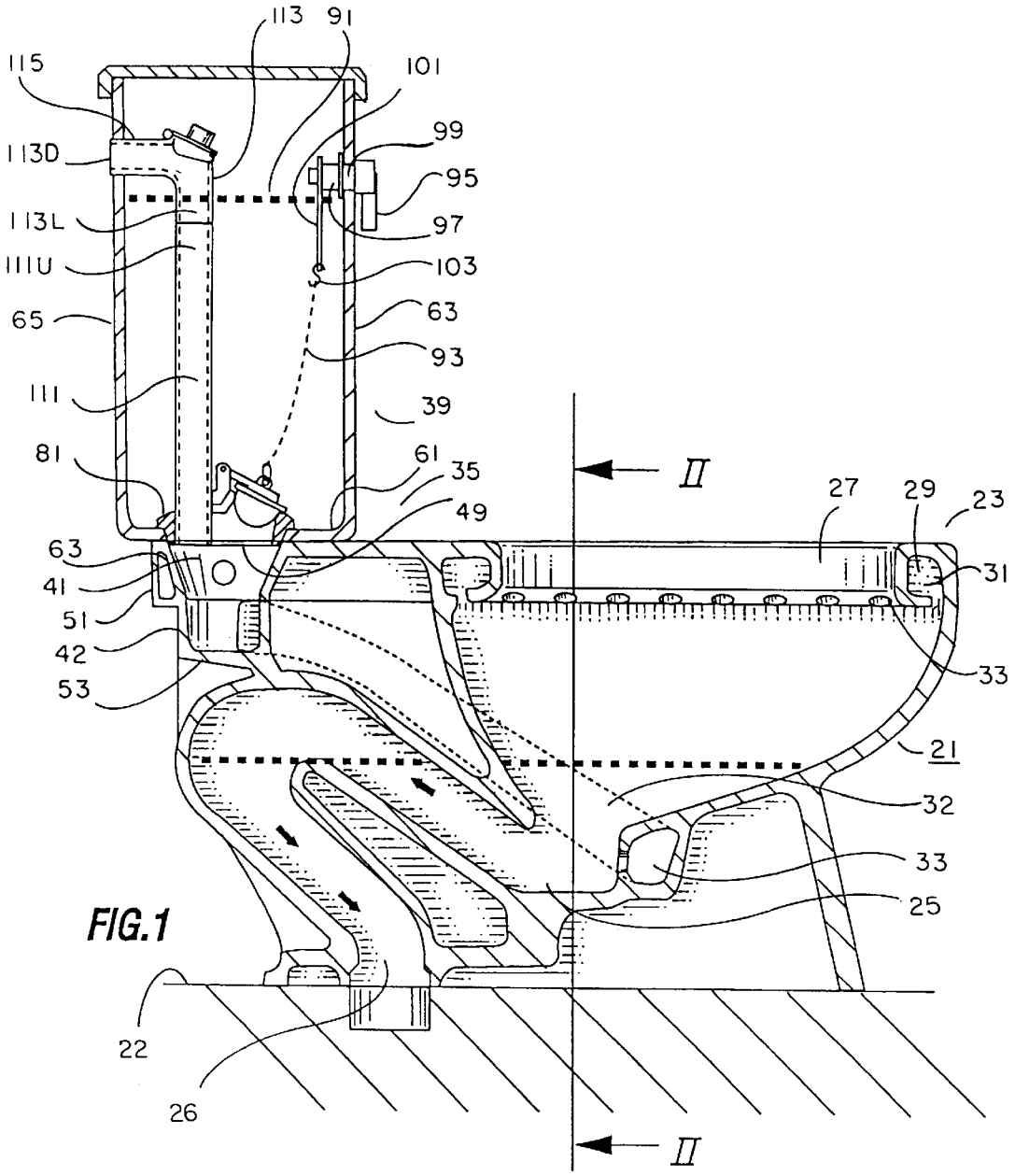
FIG. 1 is a cross-sectional view of a toilet illustrating the invention.
Figure 2:
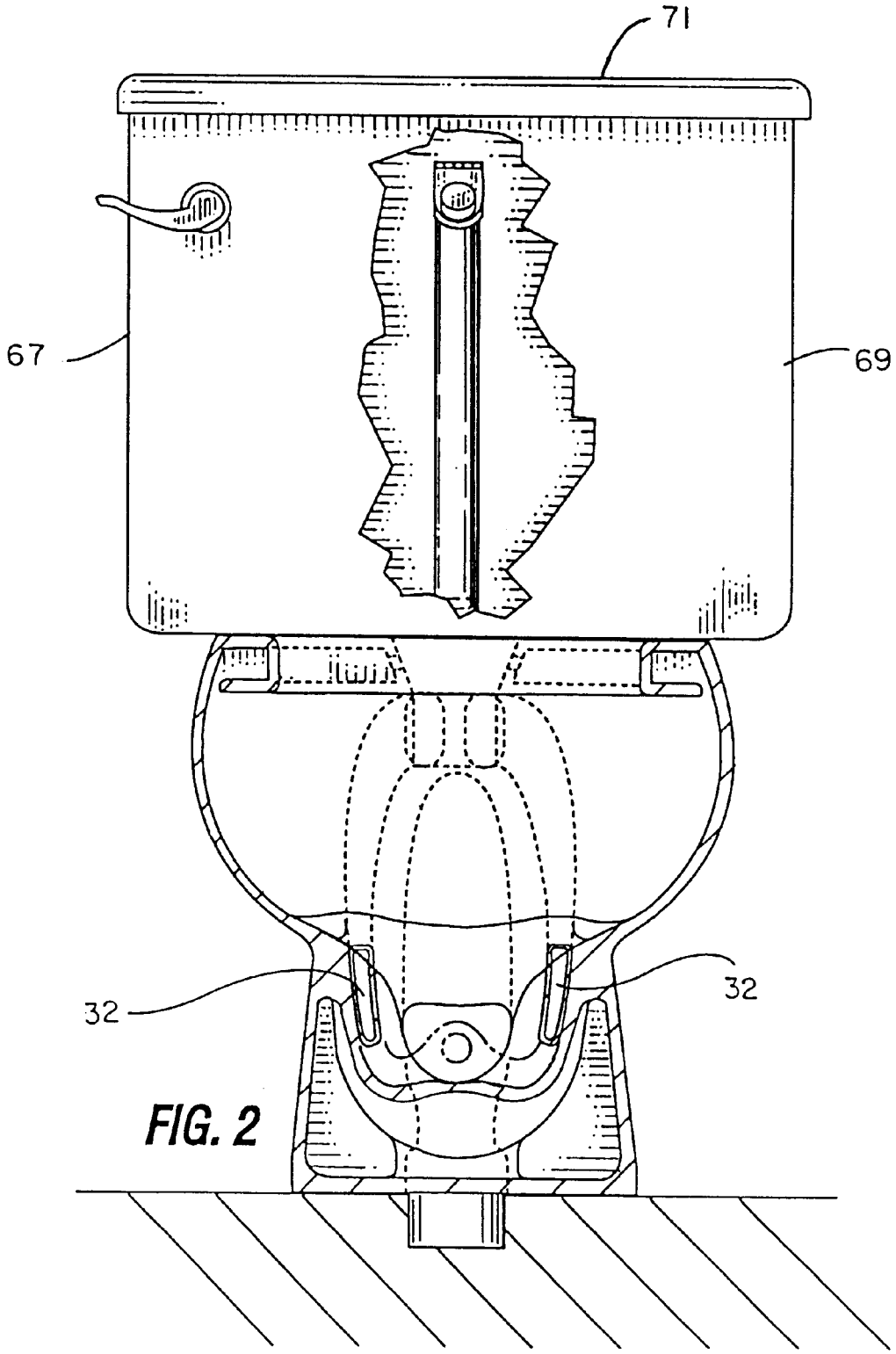
FIG. 2 is a cross-section of FIG. 1 taken along the lines 2—2 thereof.

Referring now to the drawings, there is disclosed a toilet 21 having a bowl 23 with an outlet 25 leading to a drain 26. The toilet 21 is shown in FIG. 1 supported by the floor 22 of a house or building. The toilet has an upper rim 27 surrounding the bowl which is formed by wall structure 29 forming a surrounding duct 31 with a plurality of apertures 33.

The toilet has a rear portion 35 with an upper wall 37 for supporting a water tank 39. The toilet will have a seat and lid coupled to the rear upper portion 35 for example as disclosed in U.S. Pat. No. 5,491,847 which patent is incorporated herein by reference. A conduit 41 defined by a conduit wall 42 extends into the wall 37 below the tank 39. Apertures 43 and 45 are formed through opposite sides of the wall 42 which lead to the duct 31 and to ducts 32 on opposite sides of the conduit 41. During flush periods, water flows through an aperture 49 formed through the bottom wall of the tank 39 into the conduit 41, through the apertures 43 and 45 into the duct 31 and through the aperture 33 into the bowl 23 and through the ducts 32 into the lower portion of the bowl 23 for flushing purposes. The duct 31 extends around the conduit 41 and at the rear is defined by the top wall 37, a rear wall 51 and a lower wall 53.

The tank 39 comprises a bottom wall 61, side walls comprising a front wall 63, a rear wall 65, two end walls 67 and 69 and a removable top wall or lid 71. The opening 49 is formed through the bottom wall 61. The bottom wall 61 is coupled to the upper wall 37 of the toilet at the rear 35 thereof such that the opening 49 and the conduit 41 are in fluid communication with each other. Seals (not shown) are provided between the bottom wall 61 and the upper wall 37 around the opening 49 and conduit 41. Located in the water tank 39 is a conduit 81 which is securely located in the opening 49. The conduit 81 has an opening 83, for receiving an overflow tube 111 and a slanted offset flapper valve opening 87 which is normally closed by a flapper valve 89. The flapper valve 89 is moved to an open position to allow water 91 from the tank 39 to flow through the opening 87 into the toilet for flush purposes by pulling upward on a chain 93 by rotating a handle 95 having a shaft 97 extending through an opening 99 formed through the front wall 63. The shaft 97 has one end of an extension 101 coupled thereto. The other end of the extension 101 is coupled to the chain 93 by way of a clip 103.

Figure 6:
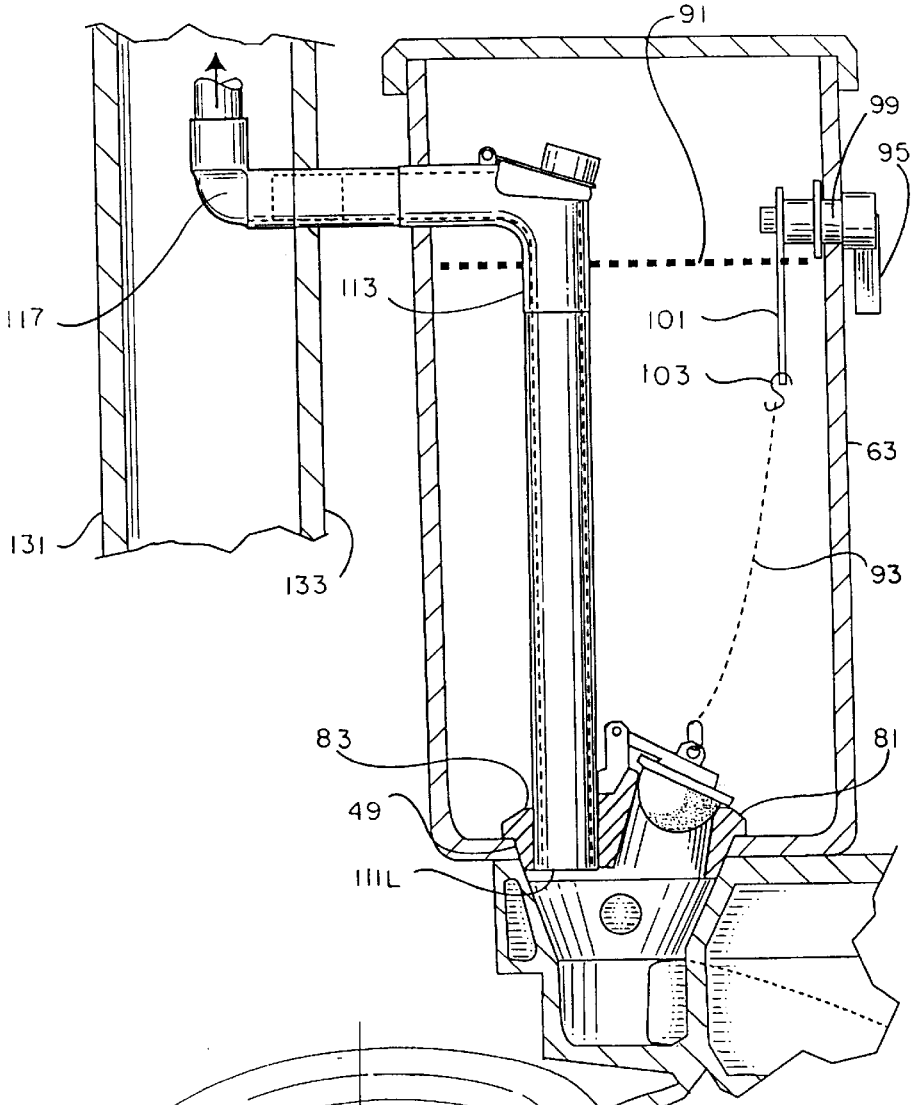
FIG. 6 is a cross-sectional view of the water tank and the exhaust tube extending out of the water tank and upward.
Figure 9:
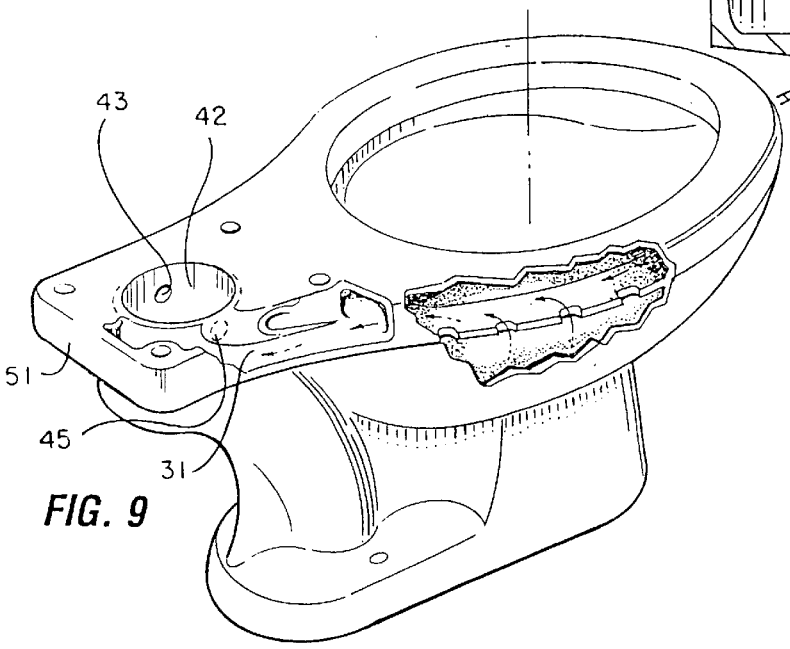
FIG. 9 is an isometric view of the toilet showing the odor exhaust path in the toilet.

Coupled to the inside of the conduit 81 is the lower end 111L of a hollow water overflow tube 111 which is in fluid communication with the conduit 41. The upper end 111U of the tube 111 has the lower end 113L of a hollow elbow 113 coupled thereto. The other end 113D of the elbow 113 extends through an opening 115 formed through the rear wall 65 of the tank 39. Coupled to the end 113D of the elbow is a hollow exhaust tube 117 which extends upward to an electric blower 121 having an outlet 123 extending through the roof 125 of the house or building in which the toilet is located. As shown in FIG. 6, the exhaust tube 117 extends upward between the wall members 131 and 133 of the house or building. The blower 121 is coupled to an AC source 135 by electrical leads 137A and 137B and is operated when a normally open switch 139, located near the toilet 21, is closed to draw air and odor from the bowl 23 through the tube 117 out of the house or building. The switch 139 may be closed manually for operating the blower 121 for a desired period of time by a person after use of the toilet. The odor flow path from the bowl 23 is by way of apertures 33, duct 31, conduit 41, tube 111, elbow 113 and exhaust tube 117.

The elbow 113 has a circular opening 141 formed through its wall at its bend 113B. An elastomer O-ring 143 surrounds the opening 141. Normally the opening 141 is closed by a float valve 149 such that a suction or low pressure can be created by the blower 121 in the passageway formed by tubes 111, 113, and 117.

Figure 3:
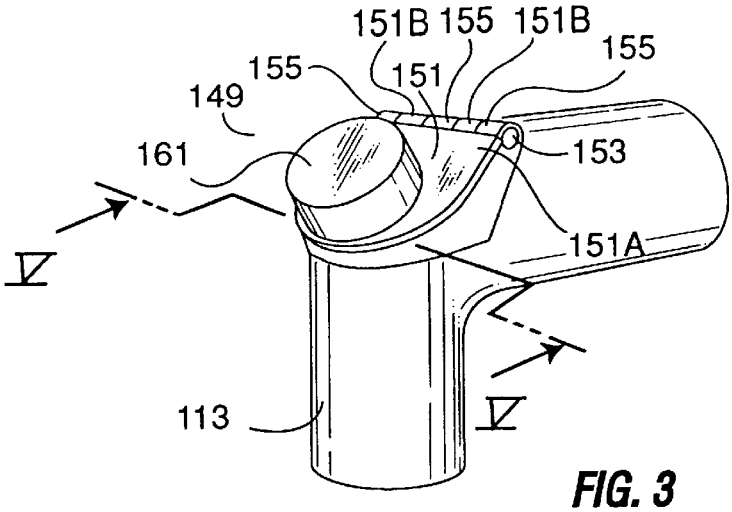
FIG. 3 illustrates a float valve employed in the water tank of FIG. 1.
Figure 4:
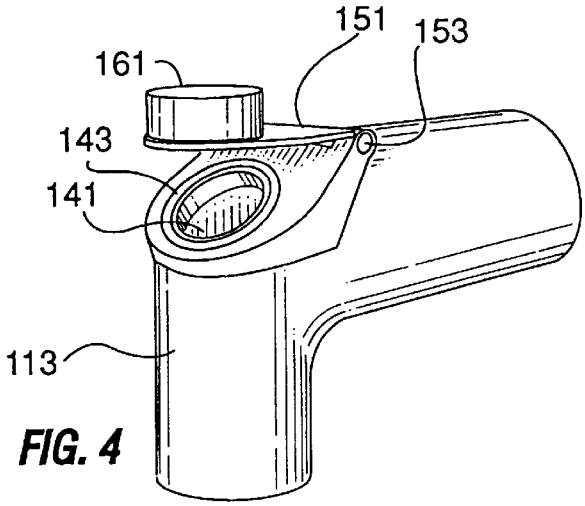
FIG. 4 illustrates the float valve in an open position.
Figure 5:
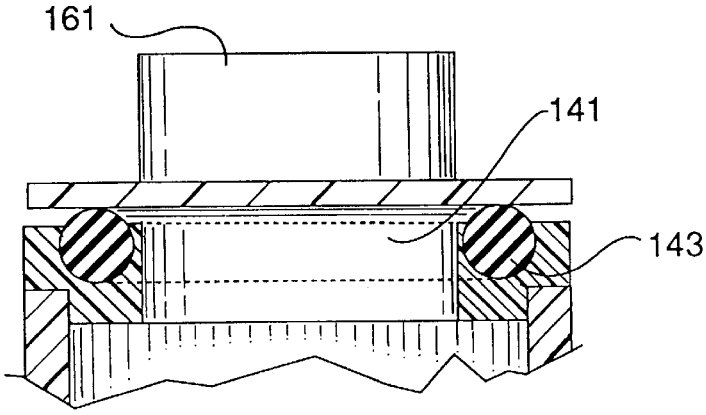
FIG. 5 is an end view of the float valve in the closed position of as seen along lines 5—5 FIG. 3.
Figure 7A:
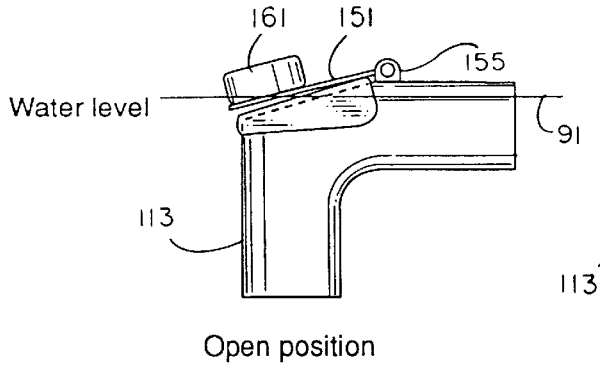
FIG. 7A is a side view of the float valve in an open position.
Figure 7B:
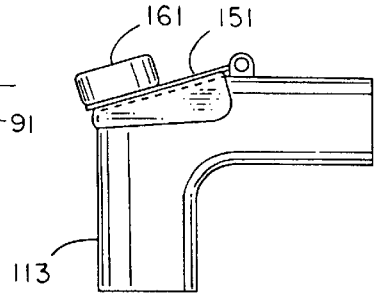
FIG. 7B is a side view of the float valve in a closed position.
Figure 8:
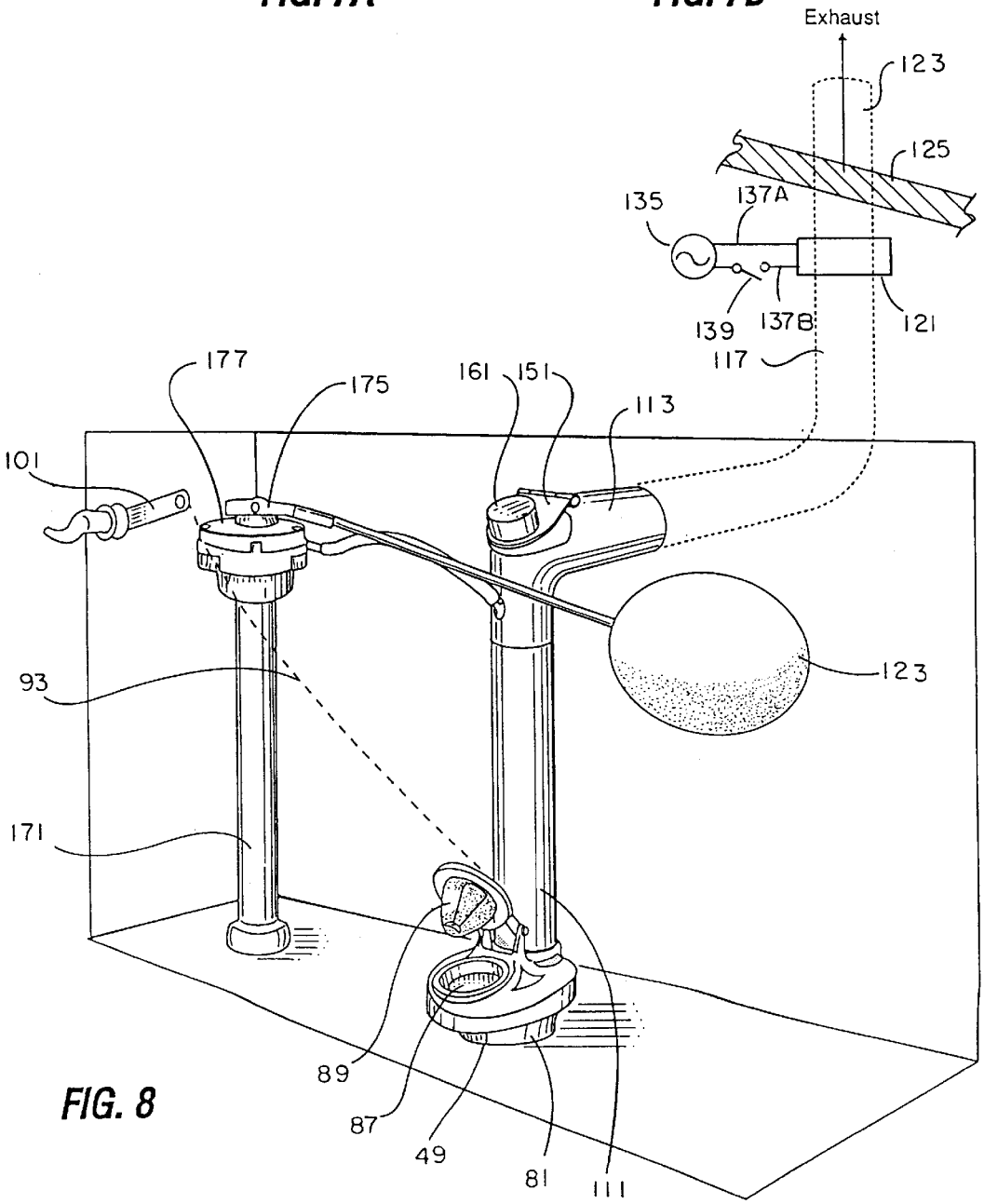
FIG. 8 is a perspective view of the components in the water tank.

The float valve 149 comprises a flat plate 151 which engages the O-ring 143 when in a closed position to form a seal and which is moved upward to an open position when the water 91 in the tank rises too high such that the excess water will flow into the overflow tube 111 and into the toilet. As shown in FIGS. 7A, 7B, and 8, the valve member 151 has an end 151 A which has loops 151 B connected thereto that extend around a rod 153 which is supported by loops 155 connected to the upper portion of the elbow 113 such that the valve may pivot or move between its closed and open positions as shown in FIGS. 3, 4, 7A, and, 7B. Attached to the top of the plate 151 is a float member 161 which can float in water. When the water 91 rises above a given level as shown in FIGS. 4, and 7A the water moves the float member 161 upward which rotates or moves the plate 151 to an open position to allow any excess water to drain into the elbow 113 and hence into the tube 111 until the water level is lowered sufficient to allow the valve plate 151 to be lowered to a closed position against the O-ring 143 as shown in FIGS. 3 and 7B.

The water flush opening 87 is located on the side of the tube 81. The usual overflow tube is not of sufficient inside diameter to allow adequate exhaust. The member 81 has a sufficient size to allow the water flush opening to be located on the side of the overflow tube 111 such that an overflow tube with a larger inside diameter may be used.

In FIG. 8, member 171 is a water inlet tube for flowing water into the tank 39 after each flush operation. Water from the tube 171 is controlled by a float 173 coupled to a rod 175 which in turn controls a valve located in structure 177 coupled to the top of tube 171.

I claim:

1. A toilet comprising:

a member having a bowl with an upper rim surrounding said bowl, and a rear portion with an upper wall, a water tank supported by said upper wall for holding water, said upper rim comprising wall structure forming an upper duct surrounding said bowl, a plurality of apertures formed through said wall structure for allowing water to flow from said duct to said toilet bowl for flush purposes, said water tank having side walls and a lower wall with a lower opening formed through said lower wall, a rear opening formed through said upper wall of said rear portion in fluid communication with said lower opening and leading to said duct for allowing the passage of water from said water tank into said duct for flush purposes, an overflow tube having a lower end in fluid communication with said rear opening and an upper end extending through one of said side walls, an overflow opening formed through said overflow tube in said water tank at an upper portion for the flow of water into said overflow tube if water in said tank reaches the level of said overflow opening, a float valve for normally closing said overflow opening, said float valve being movable to an open position by water in said tank if it rises to a given level for flow into said overflow tube, and means coupled to said upper end of said overflow tube for withdrawing air through said overflow tube to allow air and odor to be withdrawn from the vicinity of said bowl by way of said apertures, said duct, said rear opening and aid lower opening when said overflow opening is closed by said float valve.

2. The toilet of claim 1, comprising:

wall structure located in said rear opening and having a flush opening and an overflow tube opening for receiving said lower end of said overflow tube, and a flapper valve movable to a closed position for closing said flush opening for maintaining water in said tank and movable to an open position to allow water in said tank to flow by way of said upper opening, through said flush opening, into said duct for flush purposes.

3. The toilet of claim 1, wherein:

said overflow tube comprises a first portion which extends from said lower end upward to a transverse portion which extends through said one side wall, said overflow opening being formed through said transverse portion about in line with said first portion.

4. A toilet comprising:

a member having a bowl with an upper rim surrounding said bowl, and a rear portion with an upper wall, a water tank supported by said upper wall for holding water, said upper rim comprising wall structure forming an upper duct surrounding said bowl, a plurality of apertures formed through said wall structure for allowing water to flow from said duct to said toilet bowl for flush purposes, said water tank having side walls and a lower wall with a lower opening formed through said lower wall, a rear opening formed through said upper wall of said rear portion in fluid communication with said lower opening and leading to said duct for allowing the passage of water from said water tank into said duct for flush purposes, an overflow tube having a lower end in fluid communication with said rear opening with said overflow tube extending upward in said water tank to an outer portion located out of said water tank, an overflow opening formed through said overflow tube in said water tank at an upper portion for the flow of water into said overflow tube if water in said tank reaches the level of said overflow opening, a float valve for normally closing said overflow opening, said float valve being movable to an open position by water in said tank if it rises to a given level for flow into said overflow tube, and means coupled to said upper end of said overflow tube for withdrawing air through said overflow tube to allow air and odor to be withdrawn from the vicinity of said bowl by way of said apertures, said duct, said rear opening and said lower opening when said overflow opening is closed by said float valve.

5. The toilet of claim 1 wherein a flow path extends through said overflow tube between said lower end and said upper end, which extends through said one side wall, when said overflow opening is closed by said float valve and which flow path is closed to water in said tank when said overflow opening is closed by said float valve.

6. The toilet of claim 4, wherein a flow path extends through said overflow tube between said lower end and said outer portion when said overflow opening is closed by said float valve and which flow path is closed to water in said water tank when said overflow opening is closed by said float valve.

* * * * *